United States Patent [19]

Takatsuji et al.

[11] Patent Number: 4,972,307

[45] Date of Patent: Nov. 20, 1990

[54] STRUCTURE OF HEADLAMPS FOR VEHICLES

[75] Inventors: Kouichi Takatsuji; Masao Naruke; Takayuki Isobe; Masato Mochizuki, all of Kanagawa, Japan

[73] Assignees: Nissan Motor Company, Limited; Ichikoh Industries, Ltd., both of Japan

[21] Appl. No.: 348,113

[22] Filed: May 5, 1989

Related U.S. Application Data

[63] Continuation of Ser. No. 72,193, Jul. 10, 1987, abandoned.

[30] Foreign Application Priority Data

Jul. 10, 1986 [JP] Japan ..... 61-105003

[51] Int. Cl.[5] ..... F21M 3/00; F21V 7/00

[52] U.S. Cl. ..... 362/309; 362/61; 362/348; 362/339; 362/299

[58] Field of Search ..... 362/61, 80, 307, 308, 362/309, 346, 348, 349, 299, 339

[56] References Cited

U.S. PATENT DOCUMENTS

| | | | |
|---|---|---|---|
| 1,686,543 | 10/1928 | Wood | 362/309 |
| 3,857,029 | 12/1974 | Krinke | 362/309 |
| 4,276,584 | 6/1981 | Ichikawa | 362/308 |
| 4,305,119 | 12/1981 | Draper et al. | 362/309 |
| 4,523,262 | 6/1985 | Shinkai | 362/61 X |
| 4,530,042 | 7/1985 | Cibie et al. | 362/309 |
| 4,607,318 | 8/1986 | Lindae et al. | 362/309 X |
| 4,608,623 | 8/1986 | Stephano | 362/309 X |

FOREIGN PATENT DOCUMENTS

| | | | |
|---|---|---|---|
| 694291 | 7/1940 | Fed. Rep. of Germany | 362/309 |
| 2738622 | 3/1978 | Fed. Rep. of Germany | 362/80 |
| 5447282 | 9/1977 | Japan . | |
| 755155 | 8/1956 | United Kingdom | 362/309 |

*Primary Examiner*—Carl D. Price

*Attorney, Agent, or Firm*—Lowe, Price, LeBlanc, Becker & Shur

[57] ABSTRACT

A structure is provided for headlamps for vehicles, having a light source, a reflector, and a front lens in which the lens is slanted with respect to a vertical direction of a vehicle body, a rear surface of the lens is formed with a prism zone for forming a light diffusion zone on a light distribution pattern of a given screen and another prism zone for forming a hot zone on the distribution pattern, and the reflector is formed with a first reflecting surface which corresponds optically to the light diffusion zone forming prism zone and diffuses light beams emitted from the light source in a horizontal cross section with respect to an optical axis of the light source and reflects the light beams of the light source substantially in parallel to the optical axis in a vertical cross section and with a remaining reflecting surface substantially in the form of a paraboloid of revolution. Consequently, both ends of the light distribution pattern in the horizontal direction neither droop nor rise.

15 Claims, 9 Drawing Sheets

STRUCTURE OF HEADLAMPS FOR VEHICLES

This is a continuation of Application Ser. No. 07/072,193, filed July 10, 1987, now abandoned.

BACKGROUND OF THE INVENTION

The present invention relates to structures of headlamps for vehicles having a front lens, a light source, and a reflector for reflecting light incident from the light source in a direction toward the front lens, the front lens being slanted with respect to a vertical direction of a vehicle body.

A Japanese Patent Utility Model Application First Publication (Zikkai) Sho No. 54-47282 exemplifies such structure of the headlamp for vehicles.

In the above-identified Japanese Patent Utility Model Application Publication, the reflector includes a first light-reflecting surface like a substantially paraboloid of revolution at a center part thereof and a second light-reflecting surface at a peripheral portion on which flat stepwise portions and paraboloid of revolution surface having mutually different focal distances are alternatingly continued.

When some parts of the light beams from the light source fall on the center part of the reflector, they are reflected substantially in parallel to an optical axis of the light source.

On the other hand, when other parts of the light beams fall on the peripheral portion of the reflector, they become diffused and incident on the front lens which is vertical with respect to an elongated direction of a vehicle body.

To reduce the air resistance of a front surface of the vehicle body, so-called slant-type headlamps, in which the front lens is slanted with respect to the front surface of the vehicle body, are currently available on the market.

However, if the headlamp structure for vehicles disclosed in the above-identified Japanese Utility Model Application Publication is applied to the slant-type headlamp having the front lens directed upwardly with respect to the elongated direction of the vehicle body without alternation, an illumination pattern (so-called light distribution pattern) is distorted in such a form that both ends of the distribution pattern in a horizontal axial (H) direction droops with respect to an actual desirable light distribution pattern. This is best understood with reference to broken lines shown in FIG. 6, FIG. 8, FIG. 14, and FIG. 15, as compared with the actual desirable distribution pattern as denoted by solid lines in these drawings.

Consequently, it is not sufficient for the above-described structures of headlamps to visibly illuminate a left-side mark remotely located to the side of a vehicle running road, a left-side pedestrian and right-side pedestrian both walking beside the road as in the case of a road light distribution pattern i.e., the surface light distribution pattern at the time when an opposing vehicle passes aside the vehicle in a so-called asymmetrical passing beam mode. It is noted that another road surface light distribution pattern caused by another headlamp structure in which the front lens is vertically extended with respect to the elongated direction of the vehicle body can sufficiently illuminate the same left-side mark, left-side pedestrian, and right-side pedestrian thus ensuring safety driving of the vehicle.

On the other hand, in a case where the headlamp is one in which the front lens are directed downwardly, both ends of the light distribution pattern in the horizontal axial direction, in turn, rise and therefore the light irradiation by means of the headlamp structure described above in the right side direction in a country where traffic keeps to the left or on the left side in the case of U.S. may glare on the opposing vehicles passing to one side of the vehicle.

SUMMARY OF THE INVENTION

It is an object of the present invention to provide improved structures of headlamps for vehicles.

It is another object of present invention to provide the structures of headlamps for vehicles in which a front lens is slanted and both ends of a light distribution pattern on a predetermined screen in a horizontal axial direction neither droop nor rise.

The above-described objects can be achieved according to a preferred embodiment of the invention by providing a structure of a headlamp for a moving object, comprising: a housing; a light source; a lens located ahead of the light source and slanted with respect to a vertical direction of the moving object; and means for straightening both ends of a horizontally diffused light distribution pattern on a screen located in front of a front surface of the lens by a predetermined distance.

The above-described objects can also be achieved, in another aspect of the invention, by providing a structure of a headlamp for a vehicle, comprising: a housing; a light source; a front lens located ahead of the light source and slanted with respect to an optical axis of the housing and a vertical direction of a vehicle body, the front lens having a first prism zone for forming a light diffusion zone in a light distribution pattern of the head lamp on a given screen and a second prism zone for forming a light hot zone in the same light distribution pattern thereof; and a reflecting mirror for reflecting light beams emitted from the light source in a direction toward the front lens, the reflecting mirror having a first reflecting surface corresponding optically to the first prism zone for diffusing the light beams emitted from the light source in a horizontal cross section thereof with respect to an optical axis of the light source.

The above-described objects can also be achieved, in still another aspect of the invention, by providing a structure of a headlamp for a vehicle, comprising: a housing; a light source; a lens located ahead of the light source with respect to an optical axis of the light source and slanted with respect to a vertical direction of a vehicle body, the front lens having a prism zone for forming a light diffusion zone in a light distribution pattern of the head lamp and another prism zone for forming a light hot zone in the light distribution pattern; and a reflector for reflecting light beams emitted from the light source toward the front lens, the reflector being formed with a reflecting surface which corresponds to the diffusion zone forming prism zone of the front lens, diffuses the light beams emitted from the light source in a horizontal cross section thereof with respect to the optical axis, and reflects them in parallel to the optical axis in a vertical cross section and with a remaining reflecting surface substantially in a paraboloid of revolution surface shape.

DETAILED DESCRIPTION OF THE PREFERRED EMBODIMENTS

Reference will hereinafter be made to the drawings in order to facilitate understanding of the present invention.

FIRST PREFERRED EMBODIMENT

FIGS. 1 to 9 show a first preferred embodiment of the structure of the headlamp for vehicles according to the present invention.

Figure 1:
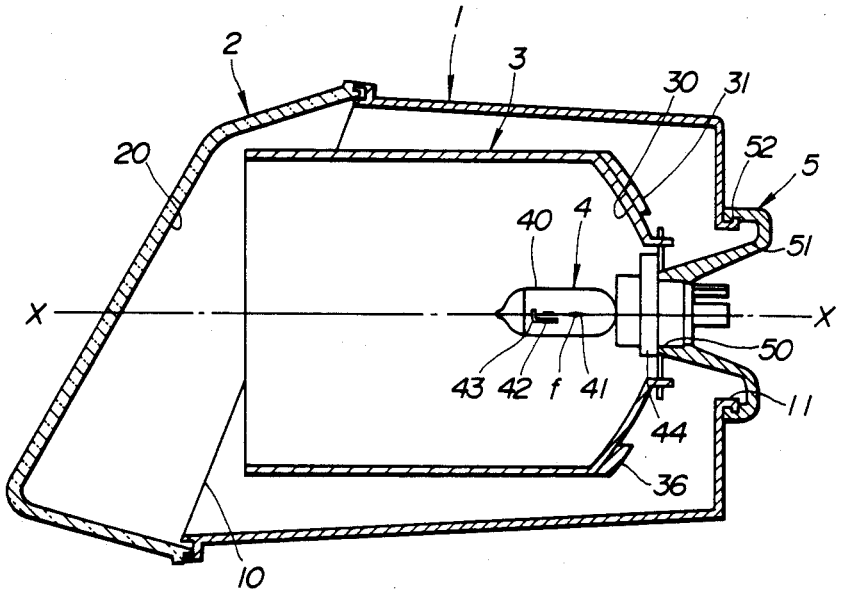
FIG. 1 is a longitudinally sectioned view of a headlamp structure in a first preferred embodiment according to the present invention.

It is noted that a pair of the headlamp structures shown in FIG. 1 are mounted on selected left and right front surfaces of a vehicle body.

Figure 2:
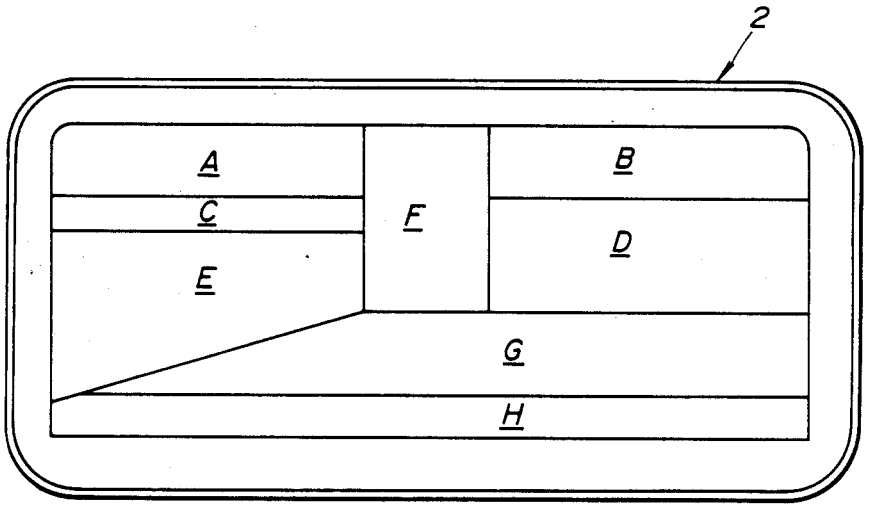
FIG. 2 is a front view of prism zones of a lens shown in FIG. 1.

In FIG. 1, a housing 1 for mounting the headlamp on the vehicle body covers a partial structure of the headlamp. The housing 1 has a front opening 10 at a front surface thereof and a rear opening 11 at a rear center surface thereof. A front lens 2 is fixed to the front opening 10 of the housing 1 through a process of bonding, packing, clipping, or the like. The front lens 2 is formed with a circular cylindrical surface prism 20 at a rear surface of the lens 2, a front surface of which is slanted so as to face in a given upper direction with respect to the housing 1. The front lens 2, as shown in FIG. 2, comprises: a first prism zone A at an upper left side of the lens 2 for forming a diffusion zone; a second prism zone B at an upper right side thereof for forming a diffusion zone; a third prism zone C at the upper left side thereof for forming a hot zone; a fourth prism zone D at an upper middle right side thereof for forming a hot zone; a fifth prism zone E at a center left side thereof for forming a hot zone; a sixth prism zone F at an upper center area thereof for forming a diffusion zone; a seventh prism zone G for forming a prism zone for forming a hot zone, exclusively used for a light beam when the vehicle runs (in a driving beam mode) at a lower side thereof; and an eighth prism zone H for forming a diffusion zone exclusively used for the light beam when the vehicle runs (in the driving beam mode) at a lower side thereof.

A reflector 3 is disposed within a light chamber defined by the housing 1 and front lens 2. The reflector 3 is provided with openings at the front surface and rear center surface, respectively. Parts 31 and 36 of the reflector 3 which correspond to the first, second, fifth, and eighth prism zones A, B, F, and H for forming diffusion zones of the lens 2 form a first reflecting surface which diffuses the light beams in a horizontal cross section with respect to an optical axis X—X and reflects the light beams in parallel to the vertical section and the remaining part 30 of the reflector 3 forms a second reflecting surface substantially like a paraboloid of revolution.

In details, as shown in FIGS. 3 to 6, the first reflecting surface in a convex form is formed a multiple number on an upper end part 31 of the reflector 3 which corresponds to the first prism zone A for forming the diffusion zone at the upper left side thereof, the second prism zone B for forming the diffusion zone at the upper right side, and the sixth prism zone F for forming the diffusion zone at the upper middle center, and on a lower end part 36 which corresponds to the eighth prism zone H for forming the diffusion zone exclusive by used for the light beam in the driving beam mode. In this embodiment, each upper and lower part of the first reflecting surface is subdivided into six blocks.

Figure 3:
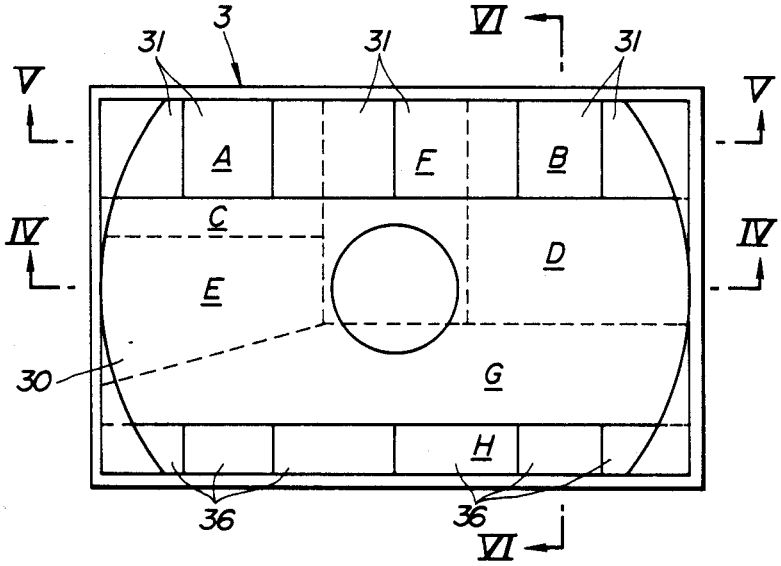
FIG. 3 is a front view of a reflector shown in FIG. 1.
Figure 4:
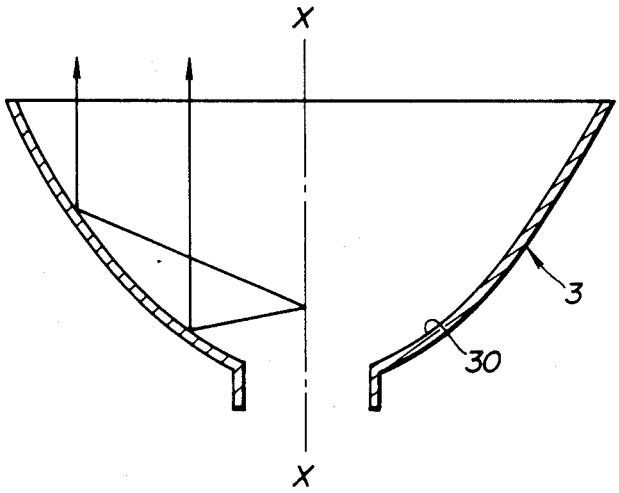
FIGS. 4, 5, and 6 are sectioned views of the reflector cut away along lines IV—IV, V—V, and VI—VI of FIG. 3.
Figure 5:
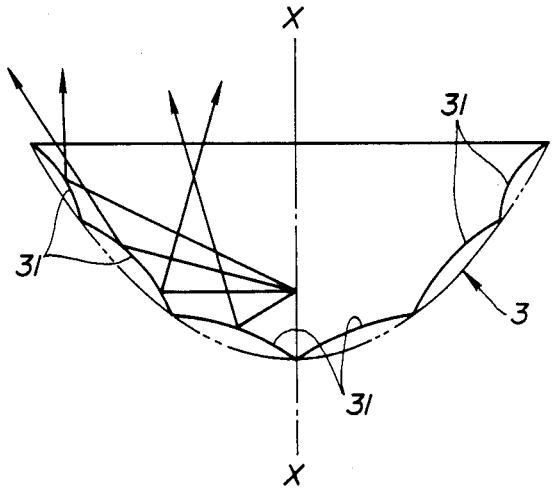

The first reflecting surface 31 and 36 is formed of continuous convex-shaped parts along a peripheral edge thereof of a semi-circular surface shown in FIG. 5 which shows the cross section taken along a line X—X of FIG. 3.

Figure 6:
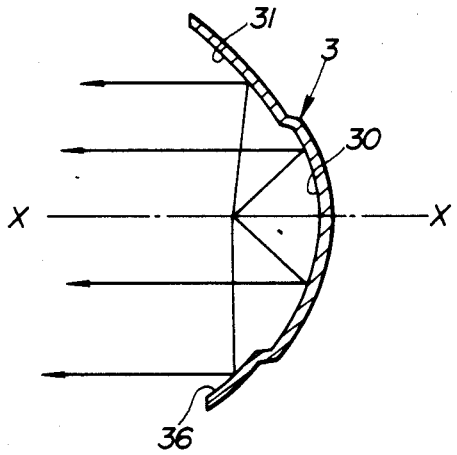

It is noted that in the cross section cut along the line VI—VI of FIG. 3 the first reflecting surface 31 and 36 takes a substantial form of parabola shown in FIG. 6.

Consequently, the first reflecting surface 31 and 36 diffuses and reflects the light beams emitted from the light source left and right in a horizontal cross section with respect to the optical axis X—X with the directions of the normal lines at different points on the convex curved surface changed. In addition, the parabolic form thereof causes the light beams from the light source to be reflected in parallel to the optical axis X—X in the vertical cross section with respect to the optical axis.

The first reflecting surface 31 and 36 having such a diffusion function as described above is formed so as to correspond to all of the first, second, and eighth prism zones A, B, and H for forming the diffusion zones of the front lens 2 and part or all of the sixth prism zone F.

In FIG. 1, an electric bulb 4 is installed as a light source. The bulb 4 includes a glass tube 40, a main filament 41 installed within the glass tube and used when the vehicle runs (in the driving beam mode), a sub filament 42 used when an opposing vehicle passes by the vehicle (in the asymmetrical passing beam mode), a shade 43, and base 44. The base 44 of the bulb 4 is attached to the opening at the center of the rear surface of the reflector 3 and the main filament 41 of the bulb 4 is located in the vicinity of a focus "f" of the second reflecting surface 30.

A water-proof cap 5 made of rubber is installed at the rear center opening of the housing 1. The water-proof cap 5 includes a transparent hole 50, skirt 51, and engagement portion 52. The transparent hole 50 of the water-proof cap 5 encapsulates the base 44 of the bulb 4 and the engagement portion 52 of the water-proof cap 5 is engaged with the rear opening 11 of the housing 1.

An operation of the headlamp structure described above is follows.

When the main filament 41 is lighted, the reflected light beam of the light transmitted from the main filament 41 advance substantially in parallel to the optical axis X—X and falls on the third prism zone C for forming the hot zone at the upper left side of the front lens 2, the fourth prism zone D for forming the hot zone at the center right side, the fifth prism zone E for forming the hot zone at the middle left side, and the seventh prism zone G for forming the hot zone exclusively used for the beam during the vehicle run at the lower part, respectively. The incident light beams on these prism zones then irradiate a front illumination area via the front surface of the front lens 2.

Figure 7:
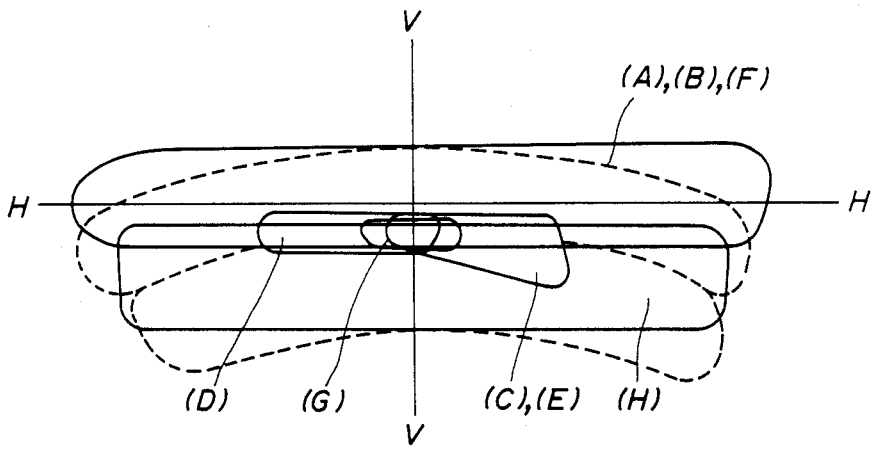
FIG. 7 is an explanatory view for explaining a light distribution pattern of light beams irradiated from the headlamps each having the structure shown in FIG. 1 in a driving beam mode.

As shown in FIG. 7, hot zones (C), (D), (E), and (G) are formed on a screen installed, e.g., 10 meters away from the front surface of the lens 2 (25 feet in SAE). In addition, the light beams which fall on and are reflected from the first reflecting surface part 31 and 36 diffuse left and right in the horizontal cross section with respect to the optical axis X—X and advances substantially in parallel to each other in the vertical cross section. The light beams, then, fall on the first prism zone A for forming the diffusion zone at the upper left side, second prism zone B for forming the diffusion zone at the upper right side, sixth prism zone F for forming the diffusion zone at the upper middle center part, and eighth prism zone H for forming the diffusion zone exclusively used for the beam in the driving beam mode, are diffused therefrom, and are irradiated toward the front illumination area.

As shown in FIG. 7, upper diffusion zone (A), (B), and (F) and lower diffusion zone (H) are formed on the above-specified screen, respectively. At this time, the light beams from the main filament 41 of the bulb 4 are diffused left and right in the horizontal cross section with respect to the optical axis X—X and are reflected substantially in parallel to the optical axis X—X in the vertical cross section. In parts of the first reflecting surface 31 and 36 of the reflector 3 which correspond optically to the first prism zone A for forming the diffusion zone at the upper left side, the second prism zone B for forming the diffusion zone at the upper right side, the sixth prism zone F for forming the diffusion zone at the upper middle center part, and the eighth prism zone H for forming the diffusion zone $ exclusively used for the driving beam at the lower part, respectively, the light beams from the main filament 41 of the bulb 4 are diffused left and right in the horizontal cross section with respect to the optical axis X—X and are reflected substantially in parallel to the axis X—X in the vertical cross section to become incident on each zone A, B, F and H of the lens 2.

Consequently, generation of such a droop as observed on both ends in the horizontal direction of the light distribution pattern denoted by the dotted lines of FIG. 7 can be prevented and a desired light distribution pattern on the above-described screen as denoted by the solid lines in FIG. 7 can be generated.

Next, when the sub filament 42 is, in turn, lighted, the reflected light beams from among those from the sub filament 42 which have fallen on the second reflecting surface 30 of the reflector 3 advance in a light collecting state (slightly downwards) with respect to the optical axis X—X. These reflected light beams fall on the third prism zone C for forming the hot zone at the upper left side, the fourth prism zone D for forming the hot zone at the upper middle right side, and fifth prism zone E for forming the hot zone at the middle left side, respectively. These incident light beams are irradiated toward the forward illumination area via the front lens 2.

Figure 8:
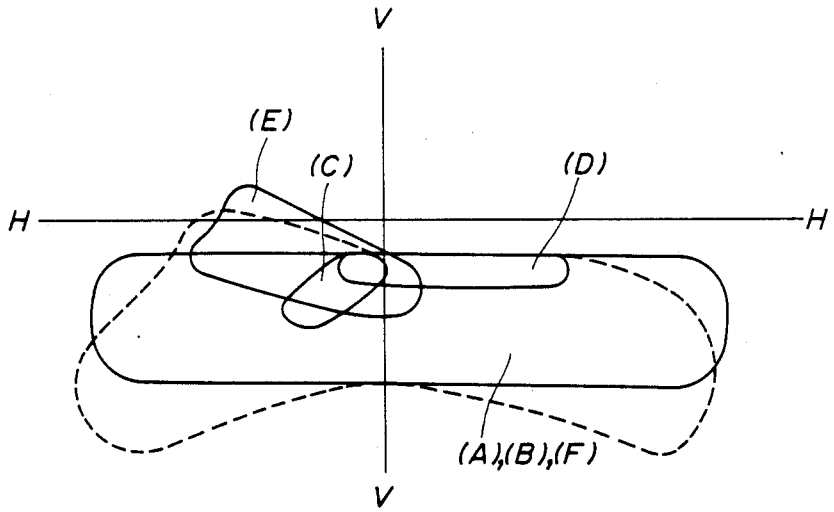
FIG. 8 is an explanatory view for explaining a light distribution pattern on a test given screen in a mode of an asymmetrical passing beam in which an opposing vehicle passes aside the vehicle in which the headlamps each of which is shown in FIG. 1 are mounted.
Figure 9:
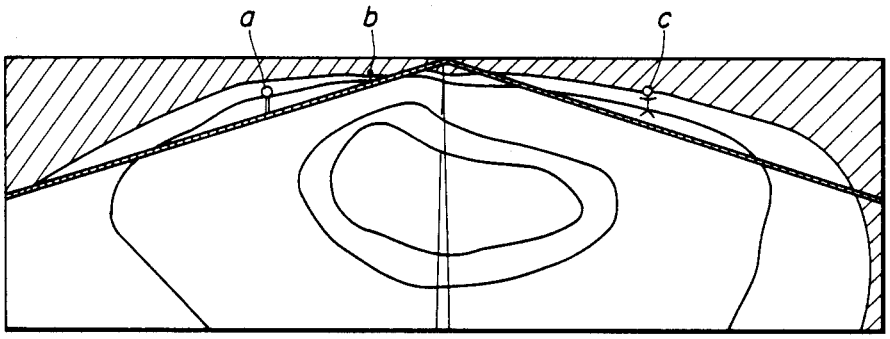
FIG. 9 is an explanatory view for explaining a road surface light distribution pattern on the given screen in the mode of the same case as shown in FIG. 8.

As shown in FIG. 8, the hot zones (C), (D), and (E) are formed on the above-described test screen. In addition, the reflected light beams which have fallen on the first reflecting surface 31 (only upper part 31 of the first reflecting surface) are diffused left and right in the horizontal cross section with respect to the optical axis X—X and advances in the light-collecting state in the vertical cross section, and falls on the first prism A for forming the diffusion zone at the upper left side, the second prism zone B for forming the diffusion zone at the upper right side, and sixth prism zone F for forming the diffusion zone at the upper middle center part, are diffused therefrom, and are irradiated toward the forward illumination area. As shown in FIG. 8, the integrated diffusion zone (A), (B) and (F) is formed on the above-described screen. Consequently, such droops generated at both ends of the light distribution pattern in the horizontal direction (H) as denoted by the broken lines of FIG. 8 can be eliminated. Consequently, the desired light distribution pattern as denoted by the solid lines in FIG. 8 can be provided. The actual road surface light distribution pattern is shown in FIG. 9. As shown in FIG. 9, such mark a on the left side of the running road, pedestrian b at the left side, and pedestrian c present at the right side can sufficiently o become visible for the driver so that safe driving can be assured, as compared with the case of the headlamp structure in the Japanese Utility Model Application Publication previously described.

In this way, since the diffusion function is provided with the reflector 3 and the light beams emitted from the light source are diffused left and right in the horizontal cross section with respect to the optical axis X—X and become incident on the prism zones for forming the diffusion zone of the front lens 2, the droops of both ends of the distribution pattern on the screen in the horizontal direction cannot be generated.

Since, in addition, the light beams from the light source fall on the prism zones A, B, F, and H for forming the diffusion zones in a state where the reflected light beams are diffused in the left and right directions with respect to the optical axis by means of the first reflecting surface 31 and 36, each radius of curvature of the prism elements in these zones A, B, F, and H may be reduced (each prism may be thinned). Therefore, such defects as fragments in each prism can be compensated for.

In the above-described embodiment, the reflector 3 is disposed within the light chamber defined by the housing 1 and front lens 2. The front lens 2 may be attached directly to the front opening of the reflector 3. In addition, since the above-described embodiment can be a vehicle headlamp in which the front lens 2 faces downward, rises at both ends of the light distribution patterns in the horizontal direction can, in this case, also be prevented.

SECOND PREFERRED EMBODIMENT

FIGS. 10 to 15 show a second preferred embodiment according to the present invention.

In FIGS. 10 to 15, the same reference numerals as those shown in FIGS. 1 to 9 designate corresponding elements.

Figure 10:
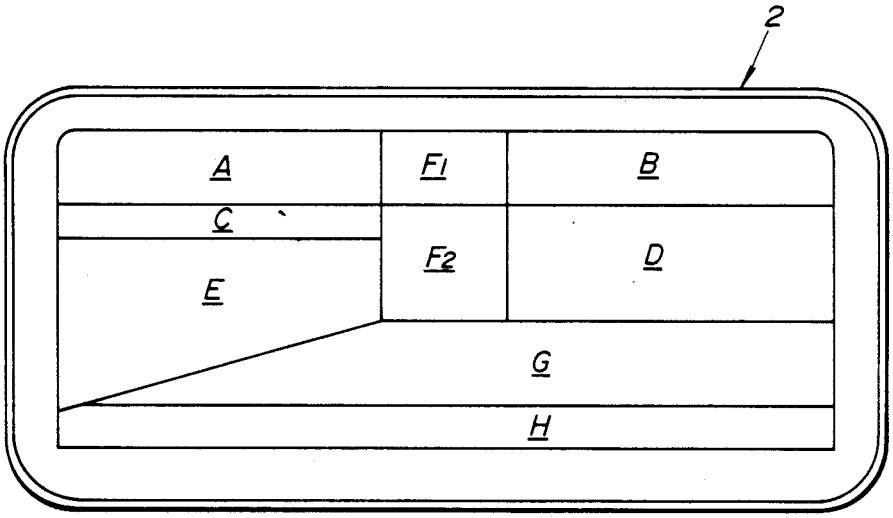
FIG. 10 is a front view of prism zones of the front lens in the headlamp structure for the vehicles in a second preferred embodiment according to the present invention.
Figure 11:
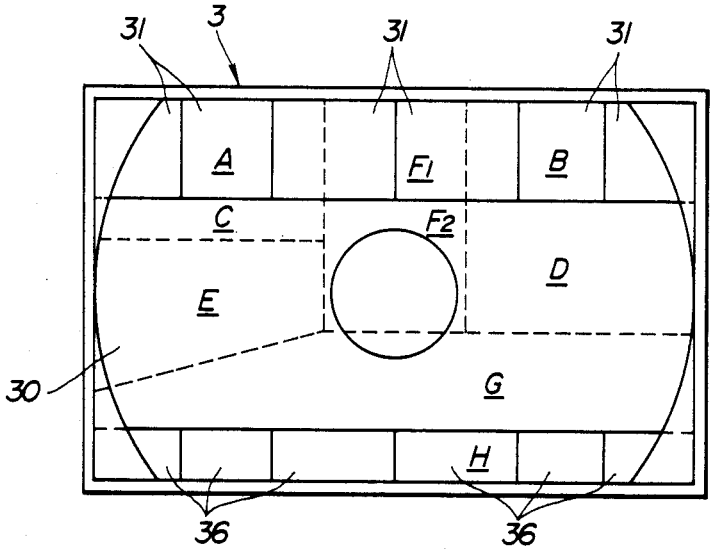
FIG. 11 is a front view of the reflector shown in FIG. 10.
Figure 12:
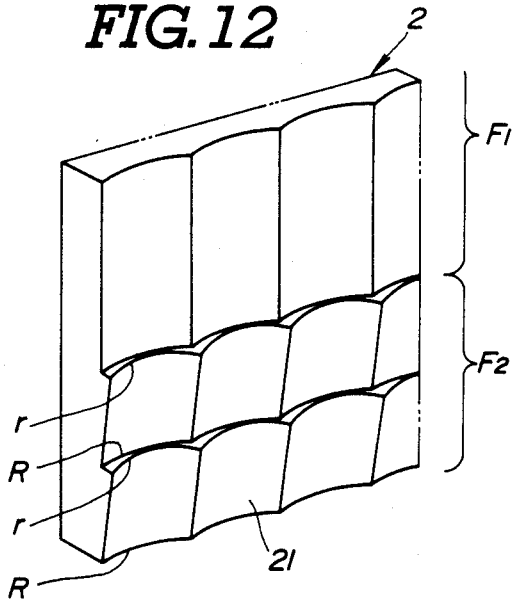
FIG. 12 is a partially perspective view of a conical surface prism.
Figure 13:
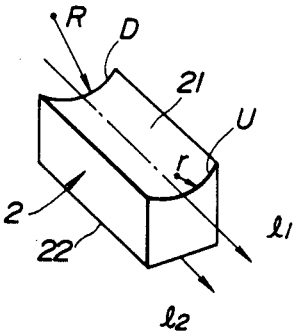
FIG. 13 is a perspective view of one of elements of the conical surface prism shown in FIG. 12.
Figure 14:
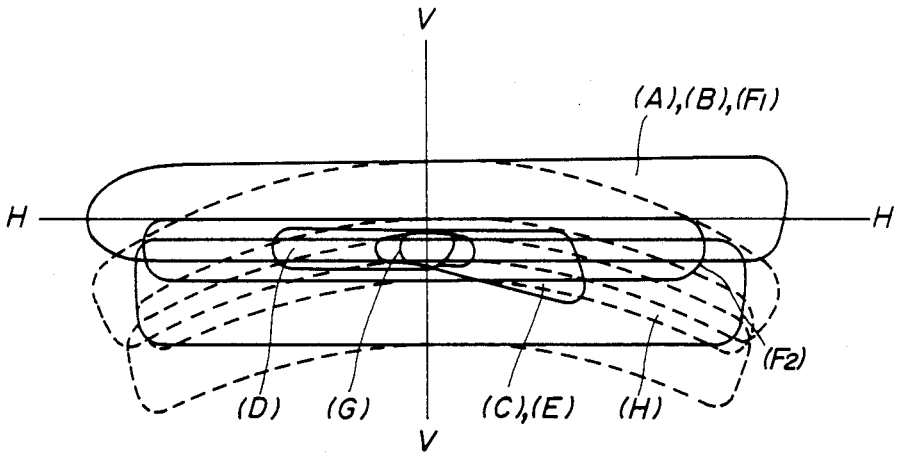
FIG. 14 is an explanatory view for explaining a light distribution pattern on the given screen of the light beam in the driving beam mode.
Figure 15:
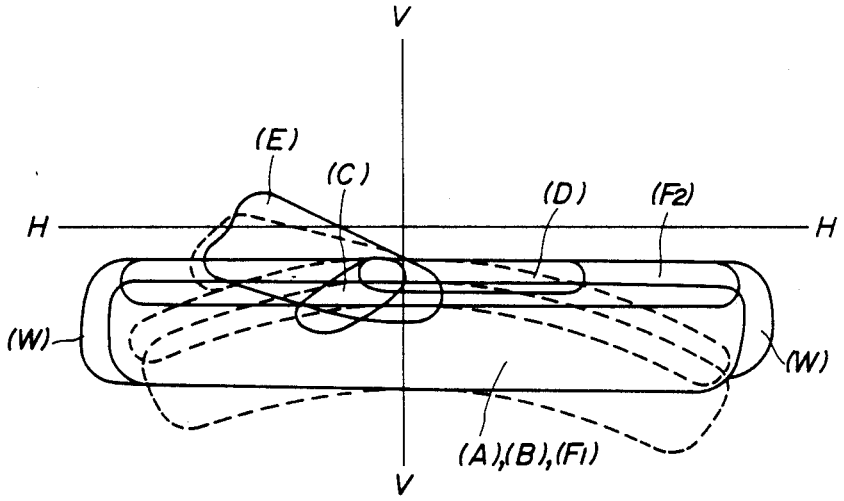
FIG. 15 is an explanatory view for explaining a light distribution pattern on a test screen in the mode of the asymmetrical passing beam in which another vehicle passes in the opposite direction.

Such a sixth prism zone F as described in the first preferred embodiment for forming the diffusion zone at the upper middle center part of the lens is subdivided into a prism zone $F_1$ for forming the diffusion zone at the upper middle center part and a prism zone $F_2$ for forming the diffusion zone at the middle center part, as shown in FIG. 10. A conical surface prism 21 is formed on the above-described prism zone $F_2$ at the middle center, the prism zone $F_1$ corresponding to the first reflecting surface 31 and the prism zone $F_2$ corresponding to the second reflecting surface 30. As shown in FIGS. 12 and 13, each element of the conical surface prism 21 is produced by cutting the rear surface of the front lens 2 in recess form with a part of conical surface cutter. The radius of curvature of one element of the conical prism 21 is changed according to the slanted direction of the lens 2. It is noted that the radius of curvature "r" at the upper part U of such conical surface prism 21 is smaller than the radius R at the lower part D thereof and the radius of curvature at an intermediate part between the upper and lower parts U and D is gradually changed from "r" to "R".

Hence, in the second preferred embodiment, if the front lens 2 faces upward, the radius of curvature in the lower part D of each conical prism 21 is made smaller while the radius of curvature in the upper part is made larger. In addition, the deepest part of the surface constituting each conical surface prism 21, in order words, a line $\lambda_1$ (most recessed bottom surface line) derived by plotting most nearest points of parts of conical surface prism 21 to the front surface 22 of the front lens 2 is made in parallel to a surface axis line $\lambda_2$. This line $\lambda_1$ corresponds to a generator of a circular cone. The light incident beams on a center part of each conical surface prism 21 are irradiated in substantially parallel to the incident light beams. In addition, the light beams incident on the vicinity of both ends of each element of the conical surface prism 21 are diffused left and right in the horizontal direction with respect to the optical axis and irradiated substantially in parallel to the optical axis in the vertical cross section.

It is noted that if the front lens 2, in turn, faces downward, the slanted direction of the conical surface prism 21 is reversed. The relationship of the radii of curvature described above are correspondingly reversed. That is to say, the radius of curvature in the upper part U is made larger and the radius "R" in the lower part D is made smaller. However, the most recessed bottom surface line $\lambda_1$ of the surface of each conical surface prism 21 is made similarly in parallel to the front surface axial line $\lambda_2$ of the surface 22 of the front lens 2.

Since the headlamp structure in the second preferred embodiment is constructed as described above, the same action and effect as in the case of the first preferred embodiment can be achieved. Furthermore, since some parts of diffused light beams reflected from the first reflecting surface 31 at a rear surface of the prism zone $F_2$ for forming the diffusion zone at the middle center part become incident on the conical surface prism 21, the light distribution pattern can become wider in the left and right directions by areas denoted by a part denoted by (W) in FIG. 15. Consequently, considerably elongated light distribution pattern in the left and right directions can be achieved as compared with a previous elongated light illumination pattern denoted by the broken lines in FIG. 15 in the case of the headlamp structure disclosed in the Japanese Utility Model Application Publication identified in the BACKGROUND OF THE INVENTION.

THIRD PREFERRED EMBODIMENT

FIGS. 16 to 19 show a third preferred embodiment according to the present invention.

In this embodiment, a diffusing reflective surface is formed on an upper end part 32 of the reflector 3 which corresponds to the first prism zone A for forming the diffusion zone at the upper left side of the front lens 2, the second prism zone B for forming the diffusion zone at the upper right side, and the sixth prism zone F for forming the diffusion zone at the upper middle center part (or the prism zone $F_1$ for forming the diffusion zone at the upper middle part) and on a lower end part 37 which corresponds to the eighth prism zone H for forming the diffusion zone exclusively used in the driving beam mode at the lower part of the front lens 2.

Figure 16:
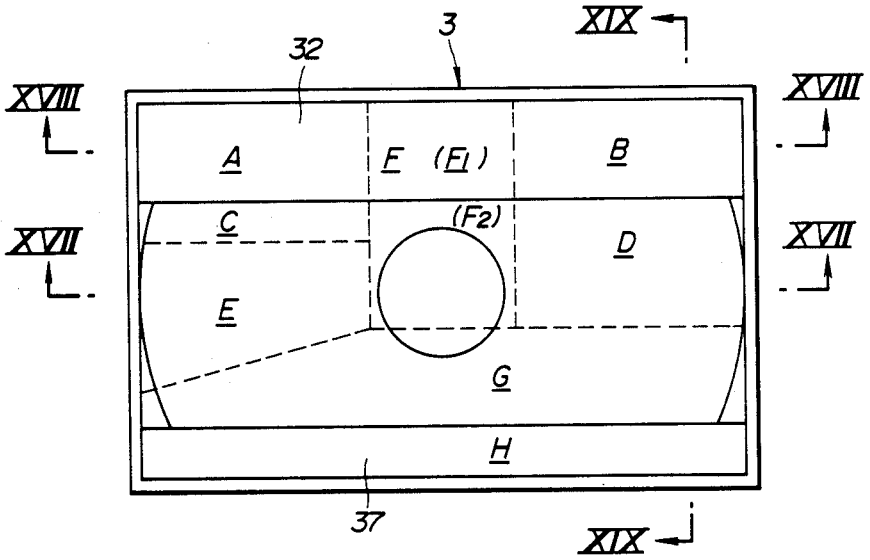
FIG. 16 is a front view of the reflector in the headlamp structure for the vehicles in a third preferred embodiment according to the present invention.
Figure 17:
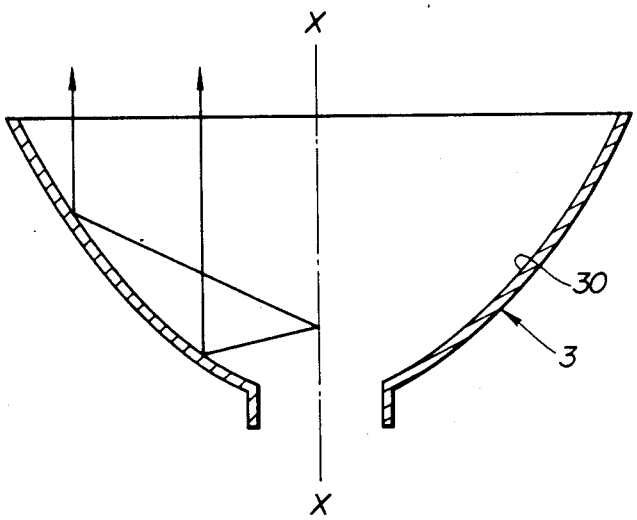
FIGS. 17, 18, and 19 are sectional views of the reflector cut away along the lines XVII—XVII, XVIII—XVIII, and XIX—XIX in FIG. 16.
Figure 18:
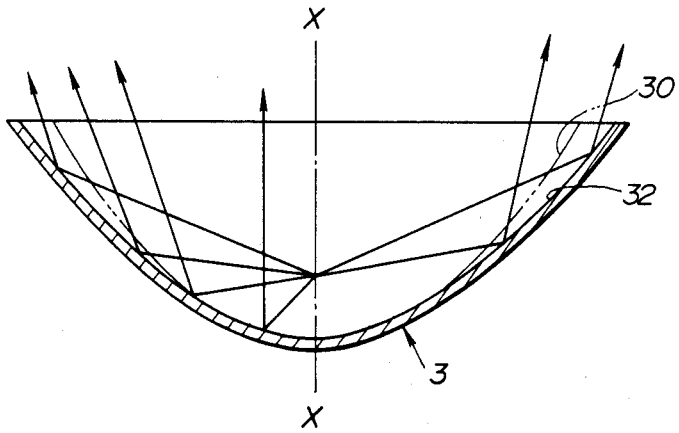
Figure 19:
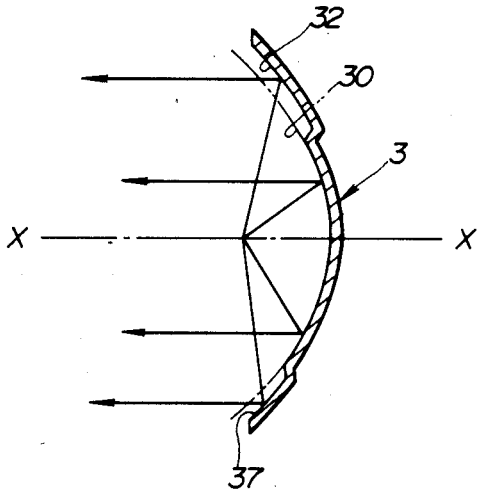

The diffusion reflecting surface 32 and 37 takes a form of a parabolic line furthermore widely opened left and right with respect to the second reflecting surface 30 as shown in FIG. 18 in the cross section cut away along the line XVIII—XVIII in FIG. 16. In addition, a substantially parabolic line is formed as shown in FIG. 19 in the cross section cut away along the line XIX—XIX of FIG. 16. Consequently, the diffusing reflective surface 32 and 37 described above is such that the light beams emitted from the bulb 4 are diffused left and right by means of the paraboloid surface of revolution more widely opened in the left and right directions than the second reflecting surface 30 in the horizontal cross section with respect to the optical axis X—X and are reflected substantially in parallel to the optical axis X—X in the vertical cross section. This preferred embodiment achieves the same effect as the first preferred embodiment.

As described hereinabove, since, in the headlamp structure for vehicles according to the present invention, the diffusion function is provided for the parts of the reflector corresponding to the prism zone for forming the diffusion zone of the front lens, the light beams emitted from the light source can be diffused left and right in the horizontal cross section with respect to the optical axis of the light source, can be reflected substantially in parallel to the optical axis in the vertical direction and can become incident on the prism zones for forming the diffusion zones of the front lens. Hence, such distortions as droops and/or rises of both ends of the light illumination pattern are avoided.

It should be understood by those skilled in the art that the foregoing description is made in terms of the preferred embodiments and that various changes and modifications can be made thereto without departing from the scope of the invention which is defined by the appended claims.

What is claimed is:

1. A structure of a headlamp for a vehicle body to provide controlled lighting forwardly of the vehicle and generally along a longitudinal axis of the vehicle body, comprising:

(a) a light source for providing light;

(b) a lens, located forwardly of the light source and slanted with respect to an optical axis of the light source and slanted with respect to a vertical direction as determined with respect to said vehicle body axis, the lens having a first prism zone for forming a light diffusion zone in a light distribution pattern of the headlamp and a second prism zone for forming a light hot zone in said light distribution pattern;

(c) a reflector for reflecting light beams emitted from said light source toward the lens, the reflector being formed with a reflecting surface which corresponds to the first prism zone of the lens and diffuses the light beams emitted from the light source in a corresponding horizontal cross-section thereof with respect to said optical axis and said vertical direction, and reflects them in parallel to the optical axis in a vertical cross-section, the reflector having a remaining reflecting surface formed substantially in the shape of a paraboloid of revolution,; and a housing such the reflector is disposed within a light chamber defined by the housing and lens.

2. A structure of a headlamp for a vehicle body, comprising:

(a) a light source for providing light;

(b) a lens, located forwardly of the light source and slanted with respect to an optical axis of the light source and slanted with respect to a vertical direction as determined with respect to said vehicle body axis, the lens having a first prism zone for forming a light diffusion zone in a light distribution pattern of the headlamp and a second prism zone for forming a light hot zone in said light distribution pattern;

(c) a reflector for reflecting light beams emitted from said light source toward the lens, the reflector being formed with a reflecting surface which corresponds to the first prism zone of the lens and diffuses the light beams emitted from the light source in a corresponding horizontal cross-section thereof with respect to said optical axis and said vertical direction, and reflects them in parallel to the optical axis in a vertical cross-section, the reflector having a remaining reflecting surface formed substantially in the shape of a paraboloid of revolution,; and a housing such the reflector is disposed within a light chamber defined by the housing and lens, wherein the reflector has an opening in front thereof and the lens is directly attached to the opening.

3. A structure of a headlamp mountable to a vehicle to provide controlled lighting forwardly of the vehicle, comprising:

a housing having a forward end and a rear end;

a light source located within the housing adjacent the rear end thereof;

a lens, located forwardly of the light source and slanted with respect to an optical axis of the headlamp, for directing light along the optical axis from said light source forwardly of the vehicle in a diffused light distribution pattern; and means for straightening both ends of said diffused light distribution pattern as would be determined in a test by projecting light from the headlamp on a test screen temporarily located for this purpose in front of the vehicle when said vehicle is stationary and said test screen is positioned in front of a front surface of the lens by a predetermined distance, the straightening means including a first straightening prism zone for forming a light diffusion zone on the screen and a second straightening prism zone for forming a hot zone on the screen, both the first and second straightening prism zones being formed on a rear surface of the lens and the first straightening prism zone having a diffusion zone formed therein, and a reflector for reflecting toward the rear surface of the lens light beams emitted from the light source, the reflector being formed to have a first surface portion corresponding optically to said diffusion zone formed in said first straightening prism zone of the lens for cooperating therewith to provide diffusion of the light beams emitted from the light source in a horizontal cross-section of the lens with respect to said optical axis and orthogonally of vertical direction as determined with reference to the vehicle, the first surface portion forming a paraboloid surface in a corresponding vertical cross-section with respect to the optical axis, and a second surface portion of the reflector corresponding optically to said second straightening prism zone of the lens for reflecting the light beams emitted from the light source on said second straightening prism zone of the lens.

4. The headlamp structure as set forth in claim 3, wherein:

the light source is located at a focus of the second surface portion of the reflector so that the first surface portion of the reflector, in a corresponding horizontal cross-section thereof, as determined with respect to the optical axis of the light source, diffuses the light beams emitted from the light source and, in said vertical cross-section orthogonal to said horizontal cross-section, reflects the light beams emitted therefrom substantially in parallel to the optical axis.

5. The headlamp structure as set forth in claim 3, wherein:

the light source is located substantially in front of a focus of the second surface portion of the reflector so that the first surface portion of the reflector, in a corresponding horizontal cross-section thereof with respect to the optical axis of the light source, diffuses the light beams emitted therefrom and, in said vertical cross-section orthogonal to said horizontal cross-section, reflects the light beams emitted therefrom in a light collecting state with respect to the optical axis.

6. The headlamp structure as set forth in claim 3, wherein:

the second surface portion of the reflector is formed substantially in the shape of a paraboloid of revolution.

7. A structure of a headlamp suitable for use mounted to a vehicle body to provide controlled lighting forwardly of the vehicle and generally along a longitudinal axis of the vehicle body, comprising:

a housing having a forward end and a rear end;

a light source within said housing and located adjacent the rear end thereof;

(b) a lens, located forwardly of the light source and slanted with respect to an optical axis of the light source and with respect to a vertical direction as determined with reference to said vehicle body axis, the lens having a first prism zone for forming a light diffusion zone in a light distribution pattern of the headlamp and a second prism zone for forming a light hot zone in said light distribution pattern; and a reflector located between said light source and the rear end of the housing, arranged for reflecting light beams emitted from said light source toward the lens, the reflector being formed with a first reflecting surface which corresponds to the first prism zone of the lens and diffuses the light beams emitted from the light source in a horizontal cross-section thereof with respect to said optical axis and said vertical direction, and reflects them in parallel to the optical axis in a corresponding vertical cross-section, the reflector having a second reflecting surface formed substantially in the shape of a paraboloid of revolution, wherein said lens is provided at a rear surface facing said light source with a cylindrical surface prism having the first prism zone at an upper left side for forming a portion of said light diffusion zone, the second prism zone at an upper right side for forming a portion of said light diffusion zone, a third prism zone at an upper right side adjacent said second prism zone for forming said light hot zone, a fourth prism zone at an upper middle right side for forming a portion of said light hot zone, a fifth prism zone at a middle left side for forming a portion of the light hot zone, a sixth prism zone at an upper middle center part for forming a portion of the light diffusion zone, a seventh prism zone at a lower part for forming a portion of the light hot zone exclusively for a driving beam, and an eighth prism zone at a lowest part for forming a portion of the light diffusion zone also exclusively for the driving beam.

8. The headlamp structure as set forth in claim 7, wherein:

the reflecting surface of the reflector is located at both an upper end part of the reflector which corresponds to the first, second, and sixth prism zones and a lower end part of the reflector which corresponds to the eighth prism zone, the reflecting surface having a horizontal cross-section in a predetermined number of cone shaped surfaces the normal lines of which are changed, and having a vertical cross-section in a substantially paraboloid line shape.

9. The headlamp structure as set forth in claim 8, wherein:

the light source comprises an electric bulb, having a main filament which is located in a vicinity of a focus of the reflecting surface of the reflector and is lighted in the driving beam mode and a sub-filament which is located forwardly of the main filament along the optical axis, said sub-filament being lighted in an asymmetrical passing beam mode.

10. The headlamp structure as set forth in claim 9, wherein:

when the sub-filament is lighted, light beams that are reflected at the upper end part of the reflector diffuse left and right in the horizontal cross-section with respect to the optical axis are directed substantially in a light collecting state in the vertical cross-section and become incident on the first, second, and sixth prism zones of the lens.

11. The headlamp structure as set forth in claim 7, wherein:

the sixth prism zone is divided into a ninth prism zone for forming the diffusion zone at an upper center part of the lens and a tenth prism zone for forming the diffusion zone at a middle center part of the lens, the tenth prism zone being formed with a conical surface prism and corresponding to the reflecting surface and the ninth prism zone corresponding to the remaining reflecting surface.

12. The headlamp structure as set forth in claim 11, wherein:

one element of the conical surface prism has a radius of curvature changed in correspondence with a direction of the slant of the lens with respect to said optical axis.

13. The headlamp structure as set forth in claim 12, wherein:

the lens is slanted in a rearward direction of the housing, so as to face upward with respect to a forward movement direction of the vehicle, and the radius of curvature at an upper part of one element of the conical surface prism is formed smaller than that at a lower part thereof, a most recessed bottom surface line of the element of the conical surface prism being formed to be in parallel to a front surface axial line of the lens.

14. The headlamp structure as set forth in claim 13, wherein:

the lens is slanted in a forward direction of the housing, so as to face downward with respect to as forward movement direction of the vehicle, and the radius of curvature at an upper part of one element of the conical surface prism is formed larger than that at a lower part thereof, a most recessed bottom surface line of the element of the conical surface prism being formed to be in parallel to a front surface axial line of the lens.

15. The headlamp structure as set forth in claim 7, wherein:

the first reflecting surface of the reflector corresponds to the first, second, sixth, and eighth prism zones and is formed in a first parabola shape in a horizontal cross-section thereof which is opened left and right more widely than the second reflecting surface and is formed in substantially a second parabola shape in the vertical cross-section, said second parabola shape having a different focus from that of the second reflecting surface.

* * * * *